US010082340B2

(12) United States Patent
Hsieh

(10) Patent No.: US 10,082,340 B2
(45) Date of Patent: Sep. 25, 2018

(54) HEAT PIPE STRUCTURE

(71) Applicant: ASIA VITAL COMPONENTS CO., LTD., New Taipei (TW)

(72) Inventor: Kuo-Chun Hsieh, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 264 days.

(21) Appl. No.: 14/538,819

(22) Filed: Nov. 12, 2014

(65) Prior Publication Data

US 2016/0131436 A1 May 12, 2016

(51) Int. Cl.
*F28D 15/04* (2006.01)
*F28D 15/02* (2006.01)

(52) U.S. Cl.
CPC ..... *F28D 15/04* (2013.01); *F28D 15/0233* (2013.01); *F28D 15/046* (2013.01)

(58) Field of Classification Search
CPC ..... F28D 15/00; F28D 15/04; F28D 15/0233; F28D 15/043; F28D 15/046; H01L 23/427; H05K 7/20
USPC ..... 165/104.26, 104.33, 104.21, 104.31; 361/700, 701, 702
See application file for complete search history.

(56) References Cited

U.S. PATENT DOCUMENTS 3,786,861 A * 1/1974 Eggers ..... F28D 15/046 165/104.26
7,275,588 B2 * 10/2007 Hsu ..... F28D 15/0233 165/104.21
7,278,469 B2 * 10/2007 Sasaki ..... F28D 15/0241 165/104.26
7,845,394 B2 * 12/2010 Chang ..... F28D 15/046 165/104.21
8,490,683 B2 * 7/2013 Moon ..... F28D 15/0233 165/104.26
2007/0295486 A1 * 12/2007 Su ..... F28D 15/0233 165/104.26
2008/0210407 A1 * 9/2008 Kim ..... F28D 15/0233 165/104.26
2009/0025910 A1 * 1/2009 Hoffman ..... F28D 15/046 165/104.26
2009/0294104 A1 * 12/2009 Lin ..... F28D 15/0233 165/104.26
2010/0108296 A1 * 5/2010 Moon ..... F28D 15/0233 165/104.26

(Continued)

FOREIGN PATENT DOCUMENTS

CN 1403778 A 3/2003
CN 203132406 U 8/2013

(Continued)

*Primary Examiner* — Keith Raymond
*Assistant Examiner* — Gustavo Hincapie Serna
(74) *Attorney, Agent, or Firm* — C. G. Mersereau; Nikolai & Mersereau, P.A.

(57) ABSTRACT

A heat pipe structure includes a main body. The main body has a first board body, a second board body, a capillary structure and a working fluid. The first and second board bodies are overlapped and mated with each other to hold the capillary structure. The capillary structure is formed with at least one passage. One of the first and second board bodies is formed with a protrusion section protruding toward the capillary structure. The protrusion section is attached to the capillary structure in adjacency to the passage. Accordingly, the heat pipe structure has an extremely thin thickness.

5 Claims, 5 Drawing Sheets

(56) References Cited

U.S. PATENT DOCUMENTS

| | | | | |
|---|---|---|---|---|
| 2011/0088873 | A1* | 4/2011 | Yang | F28D 15/0233 165/104.26 |
| 2011/0303392 | A1* | 12/2011 | Horiuchi | F28D 15/046 165/104.26 |
| 2012/0031588 | A1* | 2/2012 | Huang | F28D 15/046 165/104.26 |
| 2012/0048516 | A1* | 3/2012 | He | F28D 15/046 165/104.26 |
| 2012/0111541 | A1* | 5/2012 | Yan | H01L 23/427 165/104.26 |
| 2012/0145357 | A1* | 6/2012 | Moon | F28D 15/0233 165/104.26 |
| 2012/0211202 | A1* | 8/2012 | Wu | F28D 15/0233 165/104.26 |
| 2012/0312507 | A1* | 12/2012 | Yang | B21D 53/02 165/104.26 |
| 2013/0025829 | A1* | 1/2013 | Huang | F28D 15/046 165/104.26 |
| 2013/0037242 | A1* | 2/2013 | Chen | F28D 15/046 165/104.26 |
| 2013/0126132 | A1* | 5/2013 | Chen | F28D 15/04 165/104.26 |
| 2013/0233518 | A1* | 9/2013 | Liu | F28D 15/04 165/104.26 |
| 2014/0060780 | A1* | 3/2014 | Moon | H05K 7/20336 165/104.21 |

FOREIGN PATENT DOCUMENTS

| | | | |
|---|---|---|---|
| CN | 203443443 | U | 2/2014 |
| CN | 203704740 | U | 7/2014 |
| TW | 201116795 | A1 | 5/2011 |
| TW | 201144739 | A1 | 12/2011 |
| TW | 201331535 | A1 | 8/2013 |

* cited by examiner

HEAT PIPE STRUCTURE

BACKGROUND OF THE INVENTION

1. Field of the Invention

The present invention relates generally to a heat pipe structure, and more particularly to a heat pipe structure with an extremely thin thickness.

2. Description of the Related Art

Currently, there is a trend to develop lightweight and thin electronic mobile devices. The lightweight and thin electronic mobile devices have higher and higher operation performance. However, along with the promotion of the operation performance and the reduction of the total thickness of the electronic mobile device, the internal space of the electronic mobile device for receiving electronic components is minified and limited. Moreover, when the operation performance is enhanced, the heat generated by the electronic components is increased. Therefore, a heat dissipation component is needed to help in dissipating the heat generated by the electronic components. However, due to the thinning of the electronic mobile device, the internal space of the electronic mobile device is so narrow that it is hard to arrange a heat dissipation component such as a cooling fan in the electronic mobile device. Under such circumstance, only a copper thin sheet or an aluminum thin sheet can be disposed to enlarge the heat dissipation area. However, this can hardly sufficiently enhance the heat dissipation efficiency.

In the conventional technique, a heat pipe or vapor chamber can be thinned and applied to the electronic mobile device. However, it is hard to fill powder into the thin heat pipe and sinter the powder. As a result, an extremely thin electronic mobile device can be hardly achieved. Also, after the powder is filled and sintered and when the heat pipe is flattened into a flat structure, the sintered powder or other capillary structure (mesh body or fiber body) in the heat pipe will be compressed and damaged to lose its function.

In addition, in order to more thin the conventional vapor chamber, the internal support structure is often omitted. In this case, after the vapor chamber is vacuumed and sealed, the internal chamber of the vapor chamber is likely to deform. As a result, the internal vapor passage of the conventional thin heat pipe or vapor chamber will be contracted and minified or even disappear. This will affect the vapor-liquid circulation efficiency of the heat pipe or vapor chamber. Therefore, it has become a critical issue how to improve the internal vapor-liquid circulation structure of the thin heat pipe and vapor chamber.

SUMMARY OF THE INVENTION

It is therefore a primary object of the present invention to provide a heat pipe structure, which is flexible and has an extremely thin thickness.

To achieve the above and other objects, the heat pipe structure of the present invention includes a main body. The main body has a first board body, a second board body, at least one capillary structure and a working fluid. The first and second board bodies are overlapped and mated with each other to hold the capillary structure. The capillary structure is formed with at least one passage. One of the first and second board bodies is formed with a protrusion section protruding toward the capillary structure. The protrusion section is attached to the capillary structure in adjacency to the passage.

According to the above heat pipe structure, when thinning the heat pipe, the heat pipe can still keep having a free vapor passage and an internal vapor-liquid circulation space to maintain a smooth vapor-liquid circulation. Moreover, by means of the protrusion section, during the vapor-liquid circulation of the working fluid in the main body, the vapor working fluid and the liquid working fluid are separated from each other in both radial direction and axial direction so as to reduce pressure impedance. Accordingly, the thinned heat pipe is applicable to a narrow space and is freely flexible under external force.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
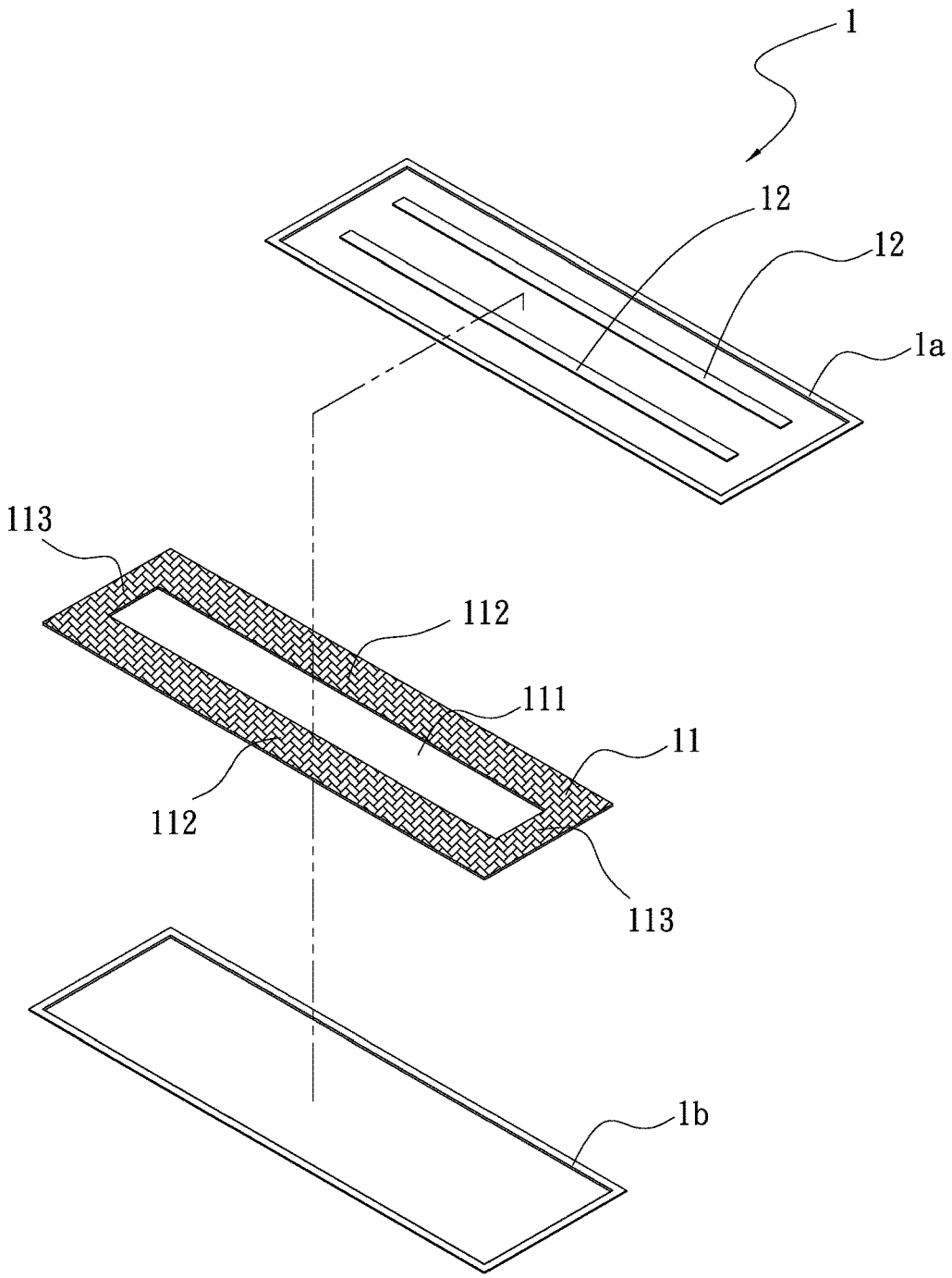
FIG. 1 is a perspective exploded view of a first embodiment of the heat pipe structure of the present invention.
Figure 2:
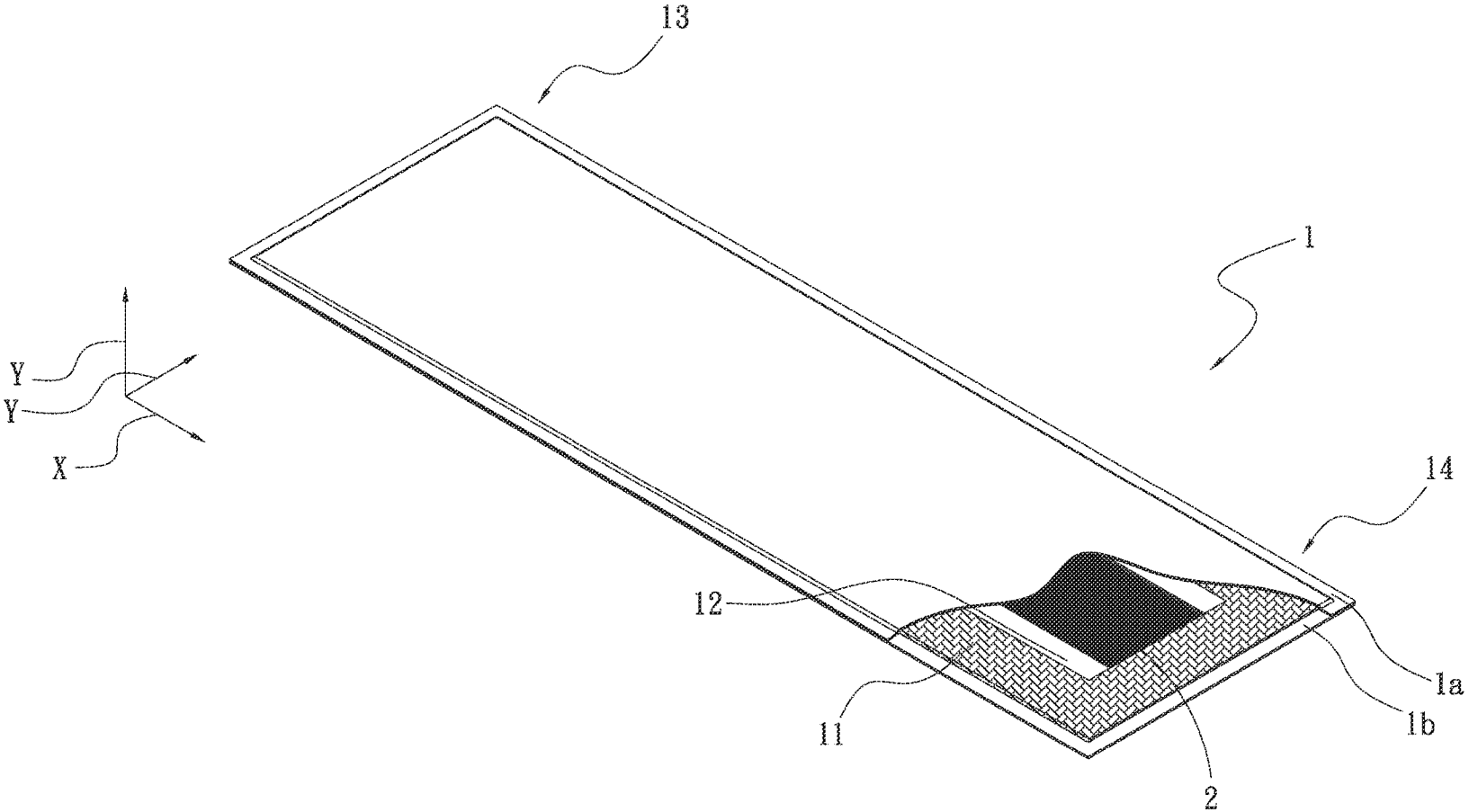
FIG. 2 is a perspective partially sectional assembled view of the first embodiment of the heat pipe structure of the present invention.

Please refer to FIGS. 1 and 2. FIG. 1 is a perspective exploded view of a first embodiment of the heat pipe structure of the present invention. FIG. 2 is a perspective partially sectional assembled view of the first embodiment of the heat pipe structure of the present invention. According to the first embodiment, the heat pipe structure of the present invention includes a main body 1.

The main body 1 has a first board body 1*a*, a second board body 1*b*, a capillary structure 11 and a working fluid 2. The first and second board bodies 1*a*, 1*b* are overlapped and mated with each other to hold the capillary structure 11 between the first and second board bodies 1*a*, 1*b*. The capillary structure 11 comprises at least one passage 111 extending in an axial direction X of the main body 1, a plurality of long sections 112 and a plurality of short sections 113. The passage 111 is also formed through the capillary structure 11 between upper and lower sides thereof in a radial direction Y of the main body 1. Each of the short sections 113 is connected to two ends of the long sections 112, such that the long and short sections 112, 113 are connected with each other to surround the at least one passage 111.

One of the first and second board bodies 1*a*, 1*b* is formed with a protrusion section 12 protruding toward the capillary structure 11. The protrusion section 12 is a rib in adjacency to the passage 111 and in connection (contact) with the capillary structure 11.

The main body 1 has an evaporation section 13 and a condensation section 14 respectively positioned at two ends of the main body 1. Two ends of the passage 111 connect with the evaporation section 13 and the condensation section 14.

Figure 3:
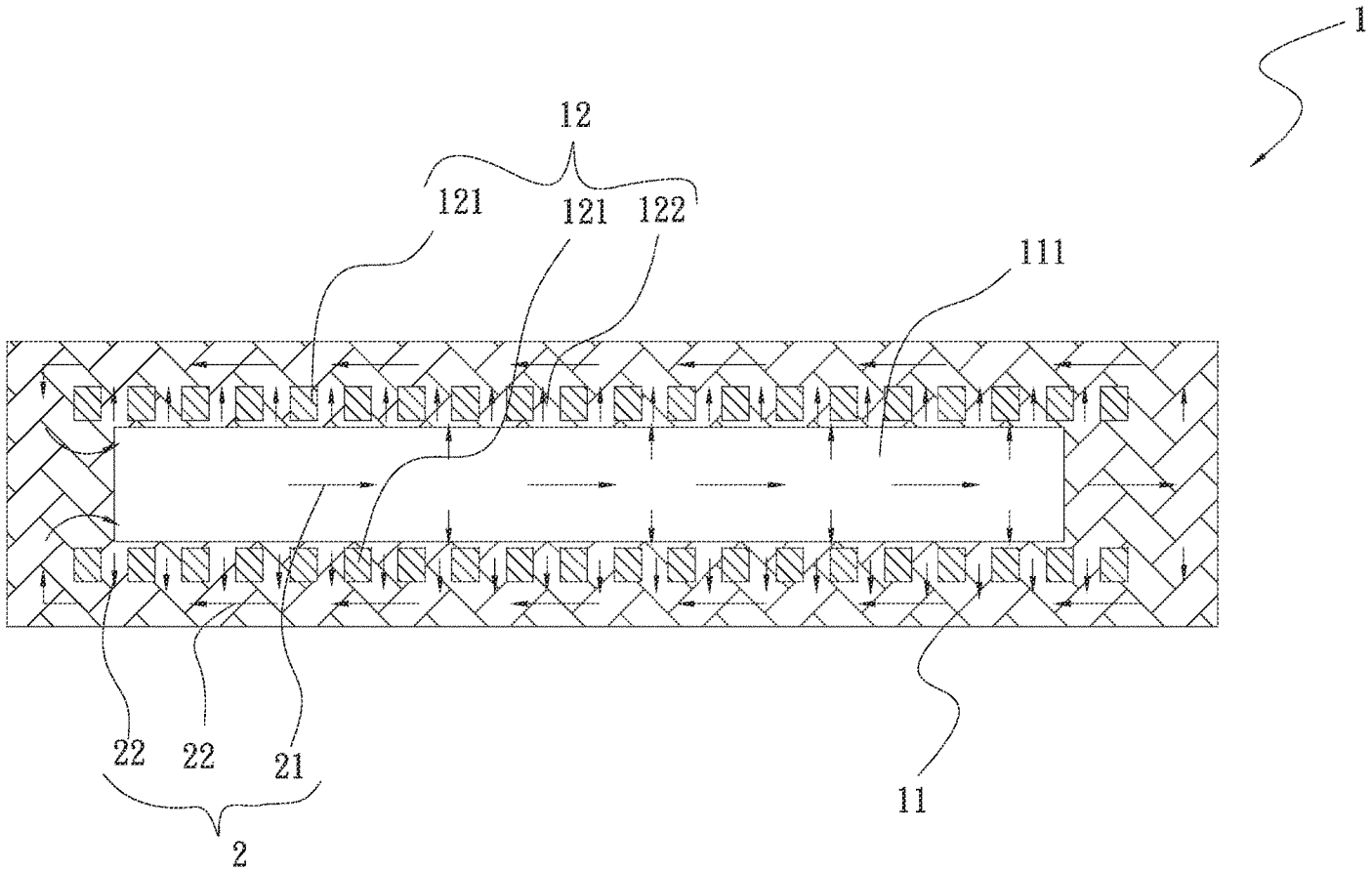
FIG. 3 is a sectional assembled view of a second embodiment of the heat pipe structure of the present invention.

Please now refer to FIG. 3, which is a sectional assembled view of a second embodiment of the heat pipe structure of the present invention. The second embodiment is partially identical to the first embodiment in structure and thus will not be repeatedly described. The second embodiment is different from the first embodiment in that the protrusion section 12 is composed of multiple protrusion bodies 121 arranged at intervals. The protrusion bodies 121 define therebetween at least one passageway 122. The multiple protrusion bodies 121 serve to make the vapor working fluid 21 spread and circulate within the passage 111 in the axial direction X of the main body 1. Under the capillary attraction of the capillary structure 11, the liquid working fluid 22 circulates in the axial direction X of the main body 1 reverse to the spreading direction of the vapor working fluid 21 and circulates along the passageway 122 between the protrusion bodies 121 in the radial direction Y of the main body 1.

Figure 4:
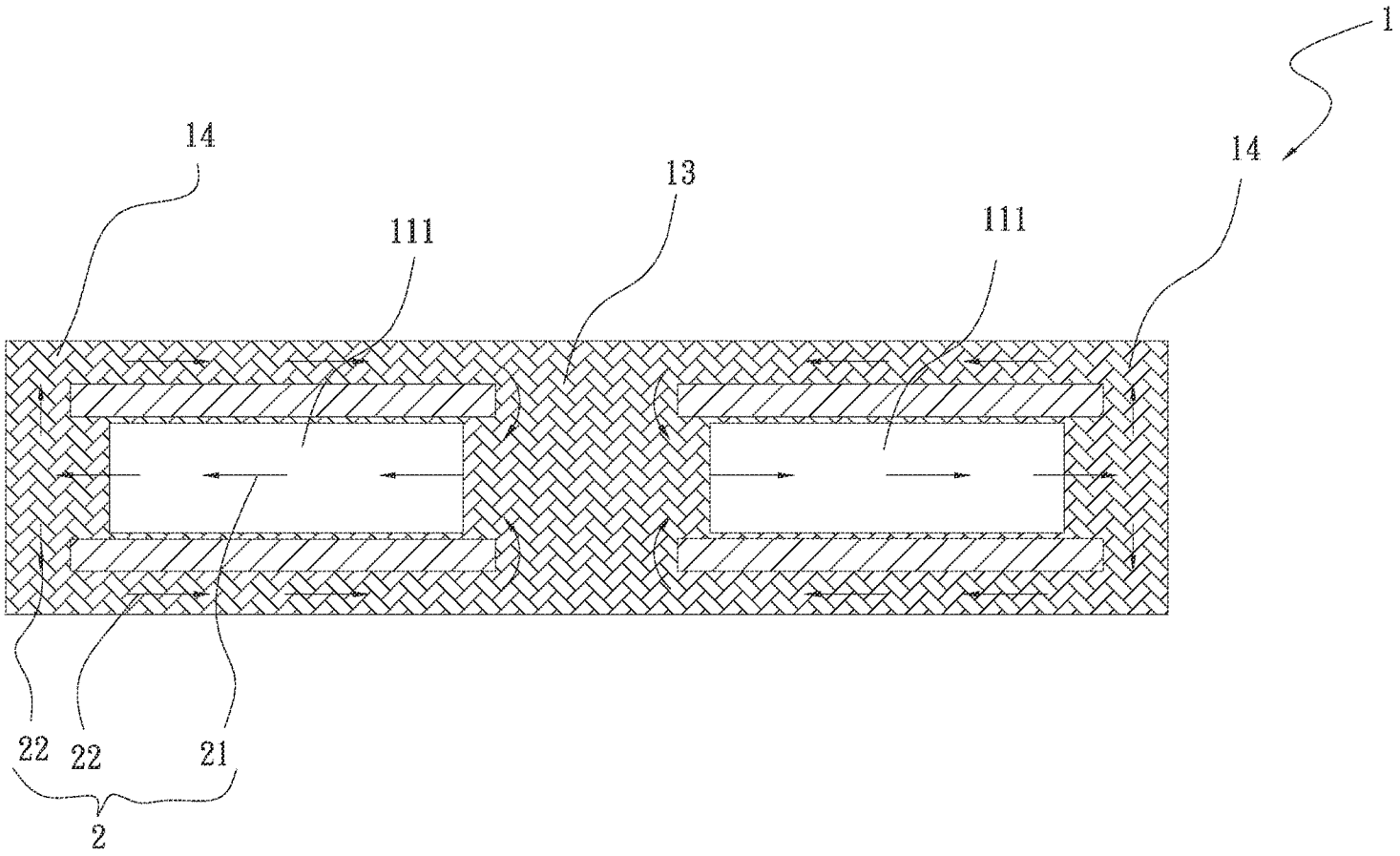
FIG. 4 is a sectional assembled view of a third embodiment of the heat pipe structure of the present invention.

Please now refer to FIG. 4, which is a sectional assembled view of a third embodiment of the heat pipe structure of the present invention. The third embodiment is partially identical to the first embodiment in structure and thus will not be repeatedly described. The third embodiment is different from the first embodiment in that the main body 1 has an evaporation section 13 and a condensation section 14. The evaporation section 13 is positioned in a central (middle) section of the main body 1, while the condensation section 14 is positioned at two ends of the evaporation section 13. Two ends of the passage 111 are connected with the evaporation section 13 and the condensation section 14. The protrusion section 12 is disposed on one side or two sides of the passage 111 in the axial direction of the passage 111.

Figure 5:
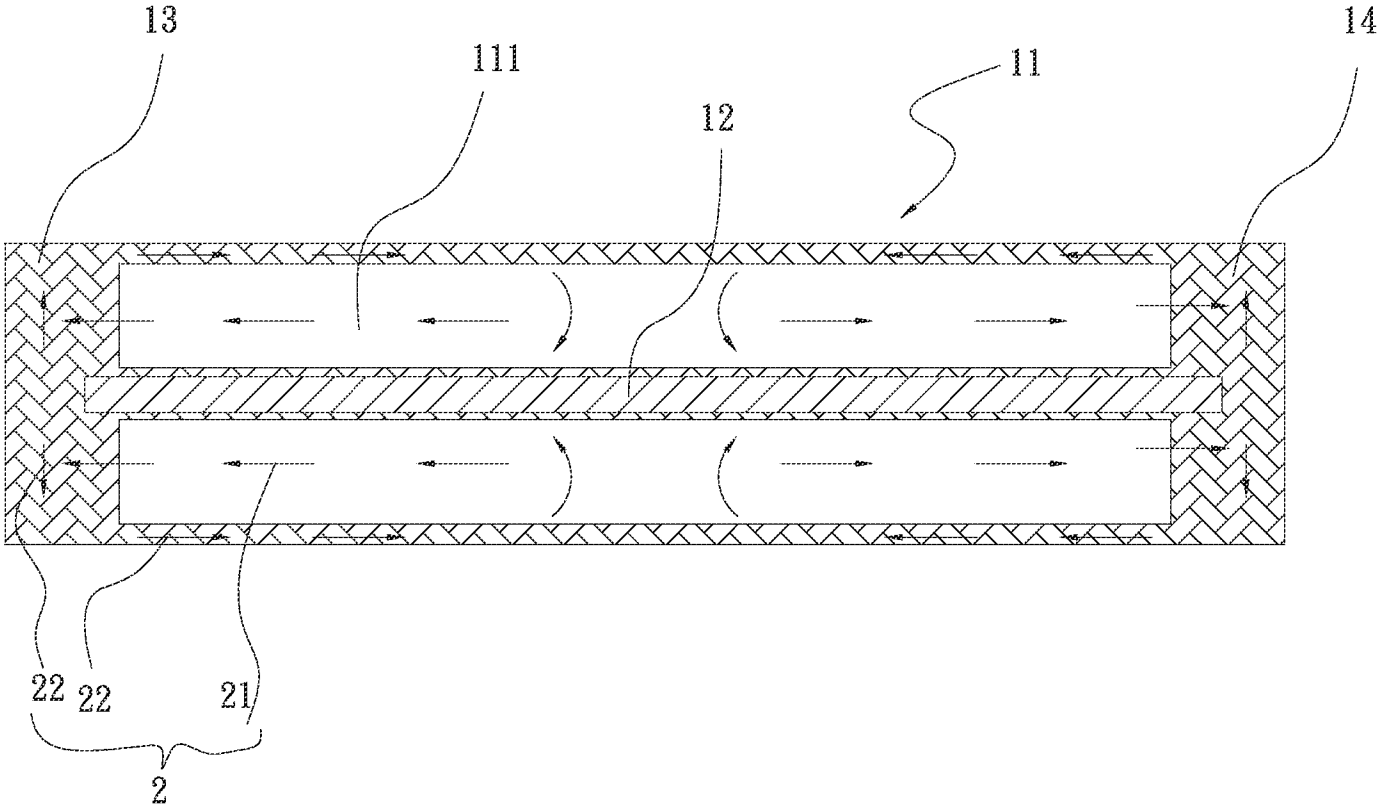
FIG. 5 is a sectional assembled view of a fourth embodiment of the heat pipe structure of the present invention.

Please now refer to FIG. 5, which is a sectional assembled view of a fourth embodiment of the heat pipe structure of the present invention. The fourth embodiment is partially identical to the first embodiment in structure and thus will not be repeatedly described. The fourth embodiment is different from the first embodiment in that the protrusion section 12 protrudes to the center of the capillary structure 11. The passages 111 are disposed on left and right sides of the protrusion section 12. The evaporation section 13 and the condensation section 14 are respectively positioned at two ends of the capillary structure 11.

In the first to fourth embodiments, the capillary structure 11 is selected from a group consisting of mesh body, fiber body, linear braided body and sintered powder body. The thickness of the first and second board bodies 1*a*, 1*b* ranges from 0.01 mm to 0.15 mm. The thickness of the capillary structure 11 ranges from 0.01 mm to 0.2 mm.

The protrusion section 12 is selected from a group consisting of a rib, continuous protrusion bodies or discontinuous protrusion bodies.

In the present invention, the passage 111 of the capillary structure 11 serves as a passage of the vapor. The protrusion section 12 serves as a structure body for separating the vapor working fluid 21 and the liquid working fluid 22 from each other or a structure body for condensing the liquid working fluid 22. The vapor working fluid 21 circulates within the passage 111 in the axial direction X of the main body 1, while the liquid working fluid 22 circulates within the capillary structure 11 in the radial direction Y of the main body and in the axial direction X of the main body 1 reverse to the spreading direction of the vapor working fluid 21 as shown in the drawings. Accordingly, even if the heat pipe is thinned, the heat pipe still keeps having a vapor passage and a backflow space of the working fluid 2 for vapor-liquid circulation.

The present invention has been described with the above embodiments thereof and it is understood that many changes and modifications in the above embodiments can be carried out without departing from the scope and the spirit of the invention that is intended to be limited only by the appended claims.

What is claimed is:

1. A flexible heat pipe structure comprising a main body, the main body having a first board body, a second board body, a capillary structure and a working fluid, the first and second board bodies being overlapped and mated with each other to hold the capillary structure, the capillary structure comprising at least one rectangular passage, a plurality of long sections and a plurality of short sections, each of the short sections being connected to two ends of the long sections, such that the long and short sections are connected with each other to surround the at least one rectangular passage, one of the first and second board bodies being integrally formed with elongate protrusion sections protruding toward the other board body, the protrusion sections being attached to the long sections of the capillary structure in adjacency to the rectangular passage; wherein the at least one rectangular passage serves as a passage of a vapor, and the protrusion serves as a structure body for separating a vapor working fluid and a liquid working fluid from each other or for condensing the liquid working fluid in a manner such that the vapor working fluid circulates within the rectangular passage in an axial direction X of the main body, while the liquid working fluid circulates within the capillary structure in a radial direction Y of the main body and in the axial direction X of the main body in reverse to a spreading direction of the vapor working fluid.

2. The heat pipe structure as claimed in claim 1, wherein the capillary structure is selected from a group consisting of mesh body, fiber body, linear braided body and sintered powder body.

3. The heat pipe structure as claimed in claim 1, wherein the protrusion section is selected from a group consisting of a rib, continuous protrusion bodies or discontinuous protrusion bodies.

4. The heat pipe structure as claimed in claim 1, wherein the thickness of the first and second board bodies ranges from 0.01 mm to 0.15 mm and the thickness of the capillary structure ranges from 0.01 mm to 0.2 mm.

5. The heat pipe structure as claimed in claim 1, wherein the main body has an evaporation section and a condensation section respectively positioned at two ends of the main body, two ends of the passage connecting with the evaporation section and the condensation section.

* * * * *